US009587908B2

(12) United States Patent
Bjelde et al.

(10) Patent No.: US 9,587,908 B2
(45) Date of Patent: Mar. 7, 2017

(54) SYSTEMS AND METHODS FOR CARRYING A WEAPON

(71) Applicants: Donald Carlos Bjelde, West Valley City, UT (US); Daniel M. Pena, West Valley City, UT (US); Justin E. Christensen, Grantsville, UT (US)

(72) Inventors: Donald Carlos Bjelde, West Valley City, UT (US); Daniel M. Pena, West Valley City, UT (US); Justin E. Christensen, Grantsville, UT (US)

( * ) Notice: Subject to any disclaimer, the term of this patent is extended or adjusted under 35 U.S.C. 154(b) by 127 days.

(21) Appl. No.: 14/306,016

(22) Filed: Jun. 16, 2014

(65) Prior Publication Data

US 2014/0367427 A1 Dec. 18, 2014

Related U.S. Application Data

(60) Provisional application No. 61/835,423, filed on Jun. 14, 2013, provisional application No. 61/864,260, filed on Aug. 9, 2013.

(51) Int. Cl.
*A45F 3/14* (2006.01)
*F41C 33/00* (2006.01)

(52) U.S. Cl.
CPC ..... *F41C 33/002* (2013.01); *F41C 33/007* (2013.01)

(58) Field of Classification Search
CPC ..... F41C 33/00; F41C 27/22; F41A 23/04; A45F 3/14; A45F 2003/045; A45F 2003/14; A45F 2003/142
USPC ..... 224/257–260, 262
See application file for complete search history.

(56) References Cited

U.S. PATENT DOCUMENTS

| | | | |
|---|---|---|---|
| 1,917,844 | A | 7/1933 | Keith |
| 2,915,233 | A | 12/1959 | Moomaw |
| 2,948,449 | A | 8/1960 | Aronson et al. |
| 3,081,923 | A | 3/1963 | Bagby |
| 3,221,958 | A | 12/1965 | Straight |
| 3,430,828 | A | 3/1969 | Gregson |
| 3,441,185 | A | 4/1969 | Moomaw |
| 3,495,770 | A | 2/1970 | Seltmann |
| 3,606,109 | A | 9/1971 | Brokus |
| 3,655,106 | A | 4/1972 | Wojcinski |
| 3,869,074 | A | 3/1975 | Roach |
| 3,948,423 | A | 4/1976 | Hathaway |
| 4,098,441 | A | 7/1978 | Campbell |
| 4,182,469 | A | 1/1980 | Bennett |
| 4,243,165 | A | 1/1981 | Schuler |

(Continued)

*Primary Examiner* — Brian D Nash
(74) *Attorney, Agent, or Firm* — Bryant J. Keller; Kirton McConkie, PC

(57) ABSTRACT

Systems and methods for carrying a weapon are described herein. While such systems and methods can include any suitable component, in some cases, they include a shoulder strap that is configured to attach at a shoulder portion of an upper torso garment. In some cases, the shoulder strap includes an attachment mechanism that is configured to attach the shoulder strap to the shoulder portion of the upper torso garment. In some cases, a weapon attachment, such as a D-ring and/or a lanyard is attached to the shoulder strap so as to be disposed on an anterior portion of the shoulder strap when the shoulder strap is worn by a user. In some cases, the shoulder strap is configured to retain a weapon (such as an assault rifle) in a state of near readiness. Other implementations are described.

20 Claims, 12 Drawing Sheets

(56) References Cited

U.S. PATENT DOCUMENTS

| | | | | | |
|---|---|---|---|---|---|
| 4,249,686 | A | | 2/1981 | Morwood | |
| 4,279,367 | A | | 7/1981 | Jacobs | |
| 4,311,263 | A | | 1/1982 | Bianchi | |
| 4,331,271 | A | | 5/1982 | Anderson | |
| 4,346,827 | A | * | 8/1982 | Bianchi | A45F 3/14 224/243 |
| 4,493,115 | A | | 1/1985 | Maier et al. | |
| 4,514,862 | A | | 5/1985 | A'Costa | |
| 4,515,301 | A | | 5/1985 | A'Costa | |
| 4,555,051 | A | | 11/1985 | Johnson | |
| 4,642,815 | A | | 2/1987 | Allen | |
| 4,768,689 | A | | 9/1988 | Davis | |
| 4,817,835 | A | | 4/1989 | Tarr, Jr. | |
| 4,823,998 | A | | 4/1989 | Johnson | |
| 4,903,874 | A | | 2/1990 | Shoemaker | |
| 5,134,797 | A | | 8/1992 | Turner | |
| 5,282,558 | A | | 2/1994 | Martinez | |
| 5,325,618 | A | | 7/1994 | Turner | |
| 5,358,159 | A | * | 10/1994 | Lundie, Jr. | A45F 5/00 224/245 |
| 5,358,160 | A | * | 10/1994 | Bianchi | A45F 3/14 224/192 |
| 5,575,411 | A | | 11/1996 | Hightower | |
| 5,622,297 | A | * | 4/1997 | Rogers | F41C 33/0227 206/317 |
| 5,655,803 | A | | 8/1997 | Tacoronte | |
| 5,669,170 | A | | 9/1997 | Norris | |
| 5,735,496 | A | | 4/1998 | Dube | |
| 5,832,536 | A | | 11/1998 | Kramer | |
| 5,845,833 | A | * | 12/1998 | Murphy | A45C 13/30 224/607 |
| 5,881,487 | A | | 3/1999 | Chalker | |
| 5,927,574 | A | | 7/1999 | Ruesink | |
| 5,971,239 | A | | 10/1999 | Marable | |
| 6,155,471 | A | * | 12/2000 | Lichtenberger | B25H 3/006 224/242 |
| 6,427,374 | B1 | | 8/2002 | Vaiani | |
| 6,520,390 | B2 | | 2/2003 | Verdugo et al. | |
| 6,932,254 | B2 | | 8/2005 | Eliason | |
| 7,506,470 | B2 | | 3/2009 | Pereksta | |
| 7,959,046 | B2 | | 6/2011 | Burnsed, Jr. et al. | |
| 8,056,778 | B1 | | 11/2011 | Michaux | |
| 2007/0257072 | A1 | | 11/2007 | Pena et al. | |
| 2009/0229160 | A1 | * | 9/2009 | Elliott | F41A 23/04 42/73 |
| 2012/0085802 | A1 | * | 4/2012 | Ferrante | F41C 33/046 224/587 |

* cited by examiner

SYSTEMS AND METHODS FOR CARRYING A WEAPON

CROSS-REFERENCE TO RELATED APPLICATION

This application claims priority to U.S. Provisional Patent Application Ser. No. 61/835,423, filed Jun. 14, 2013, and entitled "SYSTEMS AND METHODS FOR PROVIDING A SINGLE POINT SLING," as well as to U.S. Provisional Patent Application Ser. No. 61/864,260, filed Aug. 9, 2013, and entitled "SYSTEMS AND METHODS FOR CARRYING A WEAPON;" the entire disclosures of which are hereby incorporated by reference.

BACKGROUND OF THE INVENTION

Field of the Invention

The present invention relates to systems and methods for carrying a weapon. In particular, some implementations of the present invention relate to systems and methods for carrying a firearm (such as an assault rifle) in a position that allows a user to rapidly move the weapon into a position in which the user can aim and fire the weapon.

Background and Related Art

In many combat, hunting, and sports situations, a person can be required to carry a weapon, such as a rifle, for a relatively long period of time. As such a weapon can be somewhat heavy, the person carrying the weapon can suffer from arm fatigue when the weapon is carried in his or her arms.

In an effort to reduce arm fatigue and to otherwise facilitate the carrying of a rifle or a similar firearm, a variety of gun slings have been developed. In this regard, one example of such a sling is a two-point sling, which (in some cases) includes a shoulder strap that attaches to a gun at two points and that is configured to be rested on a user's shoulder. Another example of such a sling is a Y-sling, which (in some cases) comprises a Y-shaped sling that is configured to hang a gun from both of its user's shoulders, and down in front of the user's center mass. Still another example of such a sling is the single-point sling, which (in some cases) comprises a loop that is configured to extend around a portion of a user's neck and under the user's arm.

While many conventional gun slings have been found to help reduce arm fatigue for their users, such slings are not necessarily without their shortcomings. Indeed, some conventional slings may require a user to remove a sling entirely when such user wants to remove the gun from the user's person. In this regard, not only can this process of removing the entire sling be inconvenient, but it can also be relatively time consuming.

As another example of a shortcoming associated with some conventional gun slings, some slings are configured in such a manner that they routinely rub around and chafe a user's neck—causing discomfort and (possibly) injury. Moreover, as some slings can readily move with respect to a user's body, such slings may frequently (and inconveniently) need to be adjusted on the user's body.

In still another example of a shortcoming of some conventional gun slings, some slings are prone to tangle in a user's gear (e.g., magazine pouches, tools, and other equipment attached to the user's body). As a result, such slings can make it hard to quickly move guns supported by such slings into a desired firing position.

In yet another example, some slings hold a user's gun relatively low on the user's body. As a result, guns attached to such slings can hit against one or both of the user's legs and possibly other body parts when the user is in motion.

Thus, while techniques current exist that are used to carry weapons while reducing arm fatigue, challenges still exist, including those listed above. Accordingly, it would be an improvement in the art to augment or even replace current techniques with other techniques.

SUMMARY OF THE INVENTION

The present invention relates to systems and methods for carrying a weapon. In particular, some implementations of the present invention relate to systems and methods for carrying a firearm (such as an assault rifle) in a position that allows a user to rapidly move the weapon into a position in which the user can aim and fire the weapon.

While the described systems and methods for carrying a weapon can include any suitable component, in some non-limiting implementations, the described systems include a shoulder strap that is configured to attach over a shoulder portion of a user's upper torso garment (e.g., a tactical vest). In some such implementations, the shoulder strap further comprises an attachment mechanism (e.g., one or more straps with snaps) that is configured to attach the shoulder strap to the shoulder portion of the upper torso garment (e.g., by attaching the strap to MOLLE webbing on the garment). In some cases, the shoulder strap further comprises a weapon attachment (e.g., a ring with a lanyard) that is attached (or that attaches) to the strap so as to be disposed on an anterior portion of the shoulder strap when the shoulder strap is worn by a user.

In other non-limiting implementations, the described systems include both a shoulder strap that is configured to go over a shoulder of a user and a chest strap that is configured to extend around a chest or torso of the user. In some such implementations, the shoulder strap is connected to the chest strap. Moreover, in some such implementations, the shoulder strap further comprises a weapon attachment that is disposed on an anterior portion of the shoulder strap. In this regard, while the weapon attachment can include any suitable component, in some cases, it comprises a ring that is attached to the shoulder strap and a lanyard that is attachable to both the ring and a weapon. Additionally, in some cases, the shoulder strap and/or the chest strap are adjustable in length. Furthermore, in some cases, the weapon attachment is selectively attachable to and detachable from the shoulder strap. As a result, in some such cases, the described systems can be reconfigured so that they can be worn on either of a user's shoulders.

In still other non-limiting implementations, the described systems include a weapon stabilizer that is configured to help retain a portion of a weapon (e.g., a gun's barrel) in a desired position when the weapon is attached to the described shoulder strap via the described weapon attachment. In some such implementations, the weapon stabilizer includes a first connection element that is configured to attach to an article of clothing, and a second connection element that is configured to attach to a portion of a weapon (e.g., an accessory mount on a gun). Additionally, in some such implementations, the first and second connection elements are configured to selectively connect to and disconnect from each other. While the first and second connection elements can connect with each other in any suitable manner (e.g., by comprising complimentary portions of a hook-and-loop fastener; by one comprising a tab and the other comprising a corresponding slot; and/or in any other suitable manner), in some instances, at least one of the connection elements comprises a first magnet while the other comprises a second magnet or a magnetic material.

While the methods and processes of the present invention may be particularly useful for carrying weapons and more particularly rifles (e.g., assault rifles, hunting rifles, etc.), those skilled in the art can appreciate that the described systems and methods can be used in a variety of different applications and in a variety of different areas of manufacture. For instance, the described systems and methods can be used to carry any suitable weapon, including, without limitation, any suitable rifle, shotgun, electroshock weapon, grenade launcher, canister launcher, paintball gun, handgun, knife, sword, and/or other lethal or non-lethal weapon. Moreover, the described systems and methods can further be used to carry any other suitable object. For instance, the described systems can be used to carry a pair of binoculars, a radio (e.g., a handheld transceiver), and/or any other suitable object that can be carried from the described shoulder strap and/or other described components.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above-recited and other features and advantages of the present invention are obtained, a more particular description of the invention will be rendered by reference to specific embodiments thereof, which are illustrated in the appended drawings. Understanding that the drawings are not necessarily drawn to scale or in proper proportion, and that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE INVENTION

The present invention relates to systems and methods for carrying a weapon. In particular, some implementations of the present invention relate to systems and methods for carrying a firearm (such as an assault rifle) in a position that allows a user to rapidly move the weapon into a position in which the user can aim and fire the weapon.

In the disclosure and in the claims, the term upper torso garment, garment, and variations thereof, may be used to refer to any article of clothing and/or other gear that is configured to be worn on the upper torso of a user and that is suitable for use with the described systems and methods. In this regard, some examples of such garments include, but are not limited to, a vest (e.g., a windbreaker, a bullet-proof vest, a tactical vest, etc.), a flak jacket, body armor worn on a user's upper torso, a shirt, a coat, a jacket, and/or any other suitable article that is configured to be worn on a user's upper body.

As used herein, the term article of clothing (and variations thereof) may refer to any suitable piece of clothing or gear that is worn on a person, above and/or below the waist. In this regard, some examples of such clothing include, but are not limited to, an upper torso garment, a belt, a pair of pants, a pair of shorts, and/or any other suitable clothing.

As used herein, the term weapon (and variations thereof) may refer to any suitable weapon that can be supported by one or more embodiments of the described systems. In this regard, some examples of such weapons include, without limitation, any suitable rifle, shotgun, electroshock weapon, grenade launcher, canister launcher, paintball gun, handgun, knife, sword, and/or other lethal or non-lethal weapon that can be supported by the described carrying system.

Figure 1:
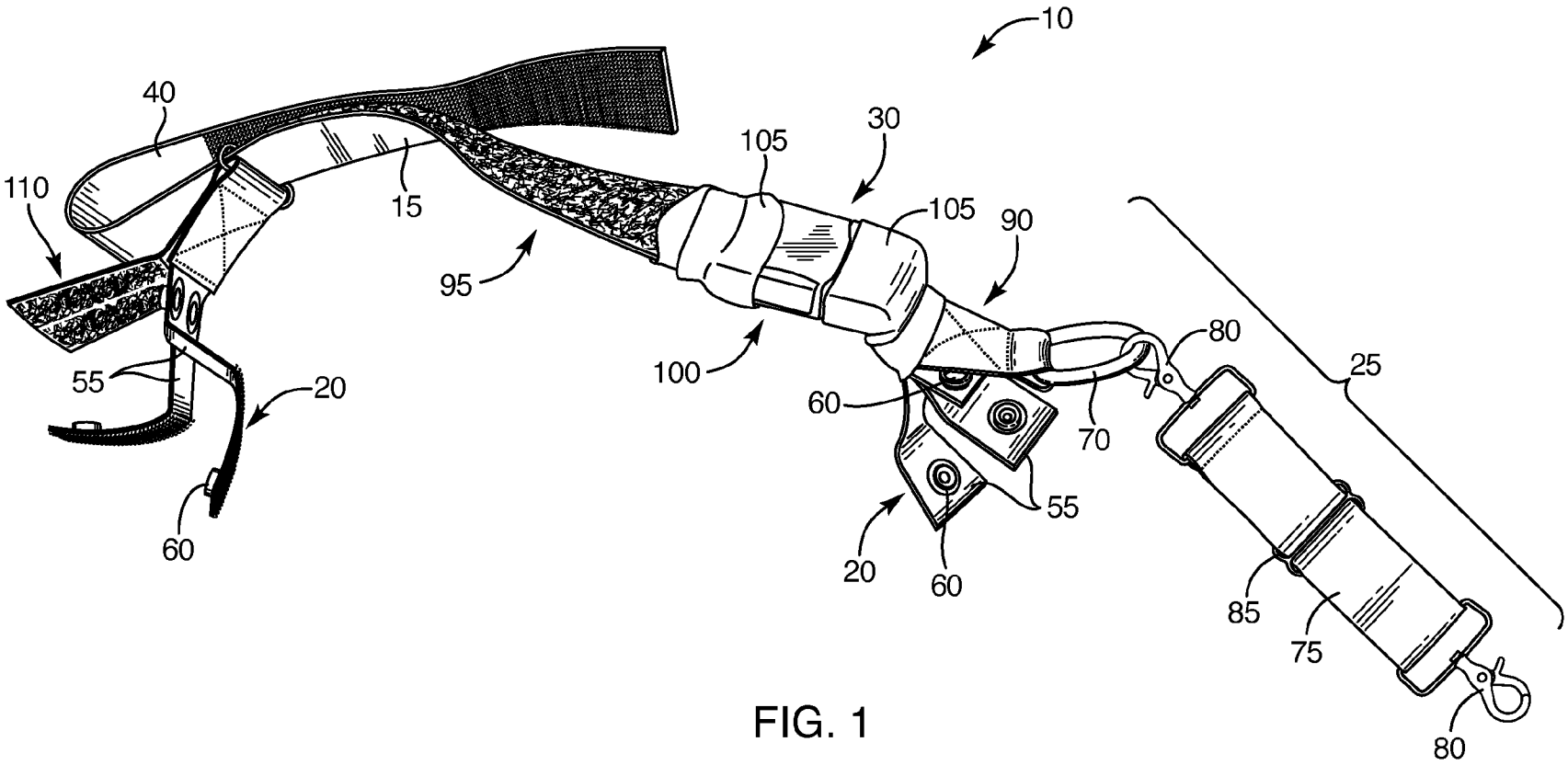
FIG. 1 illustrates a perspective view of a representative embodiment of a weapon carrying system comprising a shoulder strap.

As mentioned above, the described systems and methods relate generally to systems and methods for carrying a weapon. More particularly, some embodiments of the described systems are configured to hold a weapon (e.g., a rifle) on a user in a state of near readiness that allows the user to quickly move the weapon from a resting position to a position in which the user can readily aim and fire (or otherwise use) the weapon. While the described carrying system can have any suitable component that allows it to function as described herein, FIG. 1 shows a representative embodiment in which the weapon carrying system 10 comprises one or more shoulder straps 15, attachment mechanisms 20, weapon attachments 25, and/or shoulder strap separation mechanisms 30.

Figure 2:
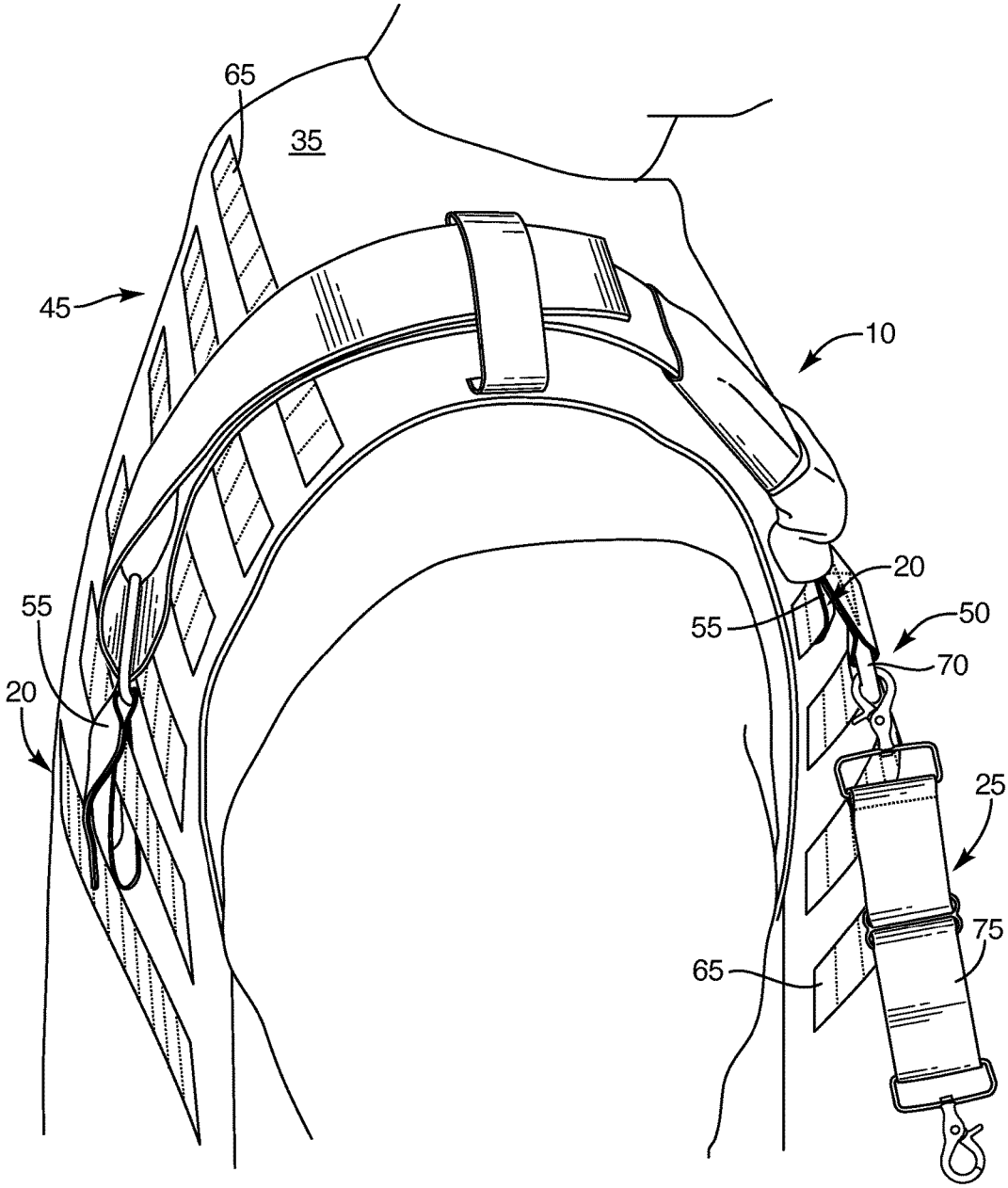
FIG. 2 illustrates a perspective view of the weapon carrying system comprising the shoulder strap, wherein the carrying system is at least partially attached to an upper torso garment, in accordance with some embodiments of the invention.

With respect to the shoulder strap 15, the shoulder strap can comprise any suitable component or characteristic that allows it to be attached to an upper torso garment (e.g., vest 35, shown in FIG. 2) and to support a weapon from such garment. In this regard, FIG. 2 shows that, in some embodiments, the shoulder strap 15 comprises an elongated piece of material 40 that is configured to extend between a posterior portion 45 (e.g., a back portion) and an anterior portion 50 (e.g., a front or chest portion) of an upper torso garment 35.

While, in some embodiments, the length of the shoulder strap 15 is fixed, in other embodiments, the shoulder strap's length is adjustable, so that it can be fit to users of a variety of sizes and/or so that it can be adjusted for a variety of different applications. Where shoulder strap's length is adjustable, the length can be adjusted in any suitable manner. Indeed, in some embodiments, the shoulder strap comprises one or more extra lengths of material that comprise one or more snaps, pieces of hook-and-loop fastener, bar slides (e.g., single-bar slides, double-bar slides, triple-bar slides, loops, rings, etc.), ladder locks, buttons/button holes, clips, and/or other suitable mechanisms that allow a length of the shoulder strap to be selectively increased and/or decreased. By way of non-limiting illustration, FIG. 1 shows a representative embodiment in which the shoulder strap 15 comprises an elongated piece of material 40 that comprises one or more pieces of hook-and-loop fastener that is folded back on itself to allow the strap's length to be selectively adjusted.

The shoulder strap 15 can attach to an upper torso garment (e.g., vest 35) in any suitable manner. In some embodiments, however, the upper torso garment and the shoulder strap each comprise one or more corresponding buttons/button holes, snap pieces, clips (e.g., suspender clips, lobster clips, trigger clips, etc.), and/or clip attachments; pieces of hook-and-loop fasteners; straps and/or strap attachments; and/or any other suitable attachment mechanism. In this regard, FIGS. 1 and 2 show that, in some embodiments, the attachment mechanism 20 comprises one or more attachment straps 55 with snaps 60 that are configured to attach to the upper torso garment (e.g., vest 35). While such straps can be connected to any suitable strap attachment (e.g., a corresponding snap, loop, ring, hole, and/or other suitable feature) on (or otherwise associated with) the upper torso garment, FIG. 2 shows that, in at least some embodiments, the straps 55 are configured to attach to one or more pieces of modular lightweight load-carrying equipment webbing 65 and/or another suitable feature of the garment (collectively and individually, "MOLLE").

The various portions of the attachment mechanism 20 can be configured to attach to any suitable portion of the upper torso garment (e.g., vest 35), including, without limitation, to a shoulder portion, an anterior portion, a posterior portion, a side portion, and/or any other suitable portion of such garment. In accordance with some embodiments, however, FIGS. 1 and 2 show the attachment mechanism 20 is configured to attach to both a posterior portion 45 and an anterior portion 50 of the upper torso garment (e.g., vest 35).

With respect to the weapon attachment 25, the shoulder strap 15 can comprise any suitable feature that allows a weapon (or other suitable object) to be attached to the shoulder strap. In some embodiments, the weapon attachment comprises one or more rings (e.g., b-rings, slotted D-rings, sewable rings, O-rings, tri-rings, loops, reducer loops, etc.); grommets; straps with a first end sewn or otherwise connected to the shoulder strap and a second end that is attachable to a weapon (e.g., via one or more clips, carabineers, ties, quick-release mechanisms, etc.); lanyards; other suitable elements; or combinations thereof. By way of non-limiting example, FIG. 1 shows an embodiment in which the weapon attachment 25 comprises a ring (e.g., a D-ring 70) and a lanyard 75.

Where the weapon attachment 25 comprises a lanyard 75, the lanyard can have any suitable characteristic that allows it to attach a weapon (or other suitable object) to the shoulder strap 15 (e.g., via a D-ring 70 or otherwise). Indeed, while some embodiments of the lanyard are permanently attached to the shoulder strap (e.g., via stitching, rivets, and/or any other suitable method), in other embodiments, the lanyard is configured to be selectively attached to and removed from the shoulder strap and/or the weapon. In the case of these latter embodiments, the lanyard can be selectively attachable to and detachable from the shoulder strap and/or weapon in any suitable manner, including, without limitation, via one or more clips (e.g., trigger snap hooks, HK hooks, lobster clips, etc.), clasps, straps, carabineers, ties, quick-release mechanisms, any other suitable mechanism, and any suitable combination thereof. In this regard, FIG. 1 shows some embodiments in which the lanyard 75 comprises a pair of clips 80 (e.g., swivel trigger snap hooks) that are configured to connect the lanyard to the shoulder strap 15 (e.g., via D-ring 70) and a weapon (not shown in FIG. 1).

Additionally, while some embodiments of the lanyard 75 are fixed in length, in other embodiments, the length of the lanyard is adjustable. In this regard, where the lanyard's length is adjustable, the lanyard can be adjustable in any suitable manner, including, without limitation, by comprising a piece of elastic material (e.g., a bungee cord, rubber, etc.) and/or an extra length of material that comprises one or more snaps, pieces of hook-and-loop fastener, bar slides (e.g., single-bar slides, double-bar, triple-bar slides, loop slides, rings, etc.), buttons/button holes, clips, and/or other suitable mechanisms that allow a length of the lanyard to be selectively increased and/or decreased. By way of non-limiting illustration, FIG. 1 shows a representative embodiment in which the lanyard 75 comprises a triple-bar slide 85 that allows the lanyard's length to be adjusted.

In some embodiments, the shoulder strap 15 optionally comprises a shoulder strap separation mechanism 30 (or separation mechanism). In such embodiments, the separation mechanism can perform any suitable purpose, including, without limitation, allowing a first portion 90 of the shoulder strap (e.g., a portion that is configured to attach to an anterior portion 50 of the upper torso garment and/or that comprises the weapon attachment 25) to be separated from a second portion 95 of the strap (e.g., a portion that is configured to attach to a posterior portion 45 of the garment). In this manner, the strap can readily be separated, and can thus be used with quick-release upper torso garments (or garments that are configured to separate into pieces, for instance, for emergency medical care, when a user enters into water and needs to immediately shed excess weight, and/or any other suitable purpose.

Where the shoulder strap 15 comprises the separation mechanism 30, the separation mechanism can include any suitable component that allows it to fulfill its intended purpose. Indeed, in some embodiments, the separation mechanism includes a clip (e.g., a belt clip, a perry belt clip, and/or any other suitable clip), a carabineer, a buckle (e.g., a side-release buckle, a front-release buckle, a belt buckle, a seatbelt buckle, and/or any other suitable buckle), a pull-pin release mechanism, a zipper, a wire that can be quickly removed to separate pieces of the shoulder strap, and/or any other suitable mechanism. By way of illustration, FIG. 1 shows a representative embodiment in which the separation mechanism 30 comprises a side-release buckle 100 that has a single button for quick release.

In addition to the aforementioned features, the described weapon carrying system 10 can be modified in any suitable manner that allows it to support a weapon (or other suitable object) from a user. In one example, the shoulder strap 15 comprises padding to increase the comfort of a user wearing the strap. In another example, the separation mechanism 30 comprises one or more sleeves and/or other covers (e.g., sleeves 105 in FIG. 1) to cover a portion of the separation mechanism and to reduce the amount of dust and debris that gets into the mechanism.

In still another example of a suitable modification, in some embodiments, the shoulder strap 15 comprises a locking mechanism to help secure one or more pieces of the attachment mechanism 20 to the upper torso garment (e.g., vest 35). In this example, the shoulder strap can include any suitable locking mechanism, including, without limitation, one or more snaps, buttons/button holes, pieces of a hook-and-loop fastener, and/or any other suitable mechanism that can help lock the attachment mechanism in place. In this regard, FIG. 1 shows a representative embodiment in which the locking mechanism 110 comprises a piece of a hook-and-loop fastener that is configured to selectively lock the attachment straps 55 in a closed position and to selectively release the straps from such position.

Figure 3:
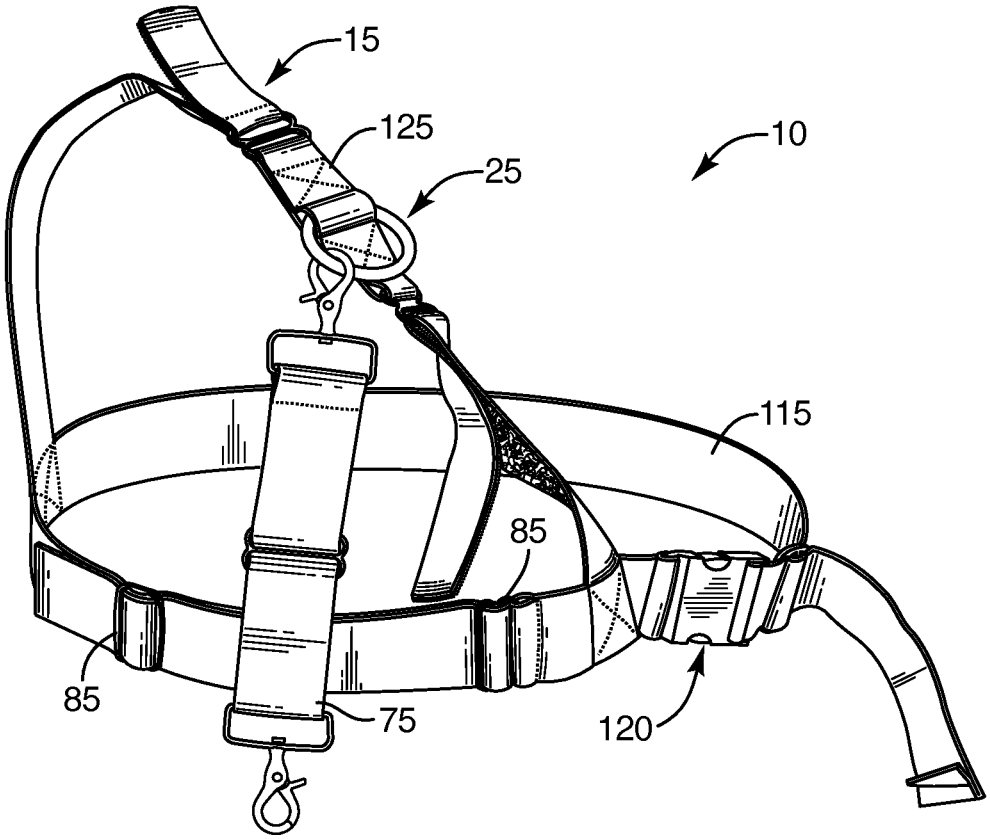
FIG. 3 illustrates a perspective view of a representative embodiment of a weapon carrying mechanism comprising a chest strap.

In yet another example of a manner in which weapon carrying system 10 can be modified, in some embodiments, the shoulder strap 15 (or a variation thereof) is used in connection with a chest strap that is configured to extend around all (or at least a portion) of a user's chest or torso. In such embodiments, the shoulder strap can attach to the chest strap in any suitable manner, including, without limitation, via stitching; by being formed together; through the use of one or more snaps, buckles, clips, rivets, hook-and-loop fasteners, ties, quick-release mechanisms, and/or similar mechanisms; and/or in any other suitable manner. By way of non-limiting illustration, FIG. 3 shows an embodiment in which the shoulder strap 15 is sewn to the chest strap 115.

Where the shoulder strap 15 is used with the chest strap 115, some embodiments of the chest strap are fixed in length. In other embodiments, however, a length of the chest strap can be adjusted in any suitable manner, including, without limitation, by comprising one or more extra lengths of material that comprise one or more snaps, pieces of hook-and-loop fastener, bar slides (e.g., single-bar slides, double-bar slides, triple-bar slides, loop slides, rings, etc.), ladder locks, buttons/button holes, clips, and/or other suitable mechanisms that allow a length of the chest strap to be selectively increased and/or decreased. By way of non-limiting illustration, FIG. 1 shows a representative embodiment in which the chest strap 115 comprises one or more slides (e.g., triple-bar slides 85) that are configured to allow the chest strap's length to be adjusted.

Where the carrying system 10 comprises a chest strap 115, the system 10 can comprise any other suitable characteristic. For instance, the chest strap can (as shown by buckle 120 in FIG. 3) include any suitable separation mechanism 30 (e.g., a buckle, clip, and/or other suitable mechanism (see buckle 120 in FIG. 3)) that allows the chest strap to be closed around and/or released form a user's chest.

Figure 4A:
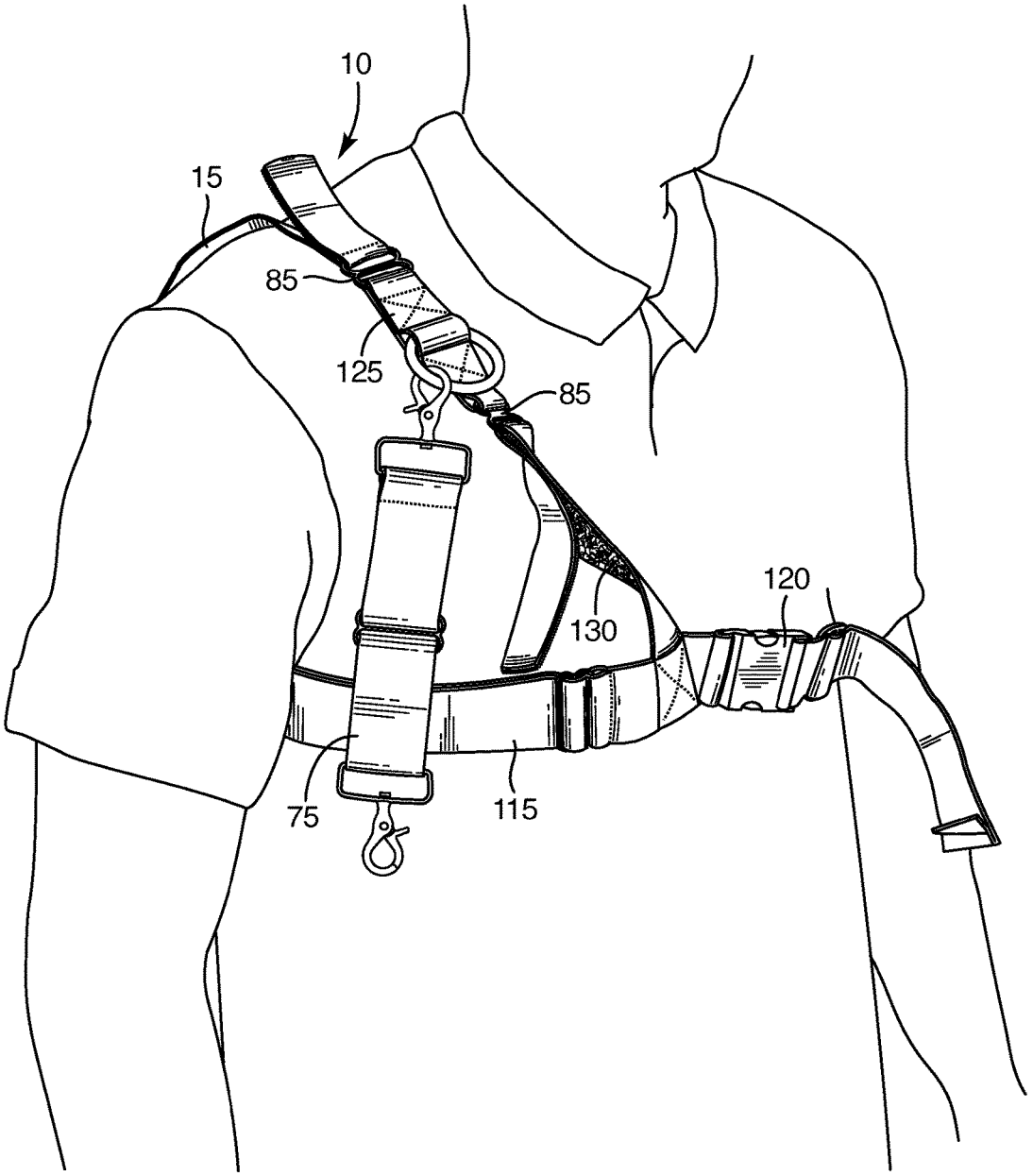
FIGS. 4A-4B each illustrate a different perspective view in which a user is wearing a representative embodiment of the weapon carrying system comprising the chest strap.
Figure 4B:
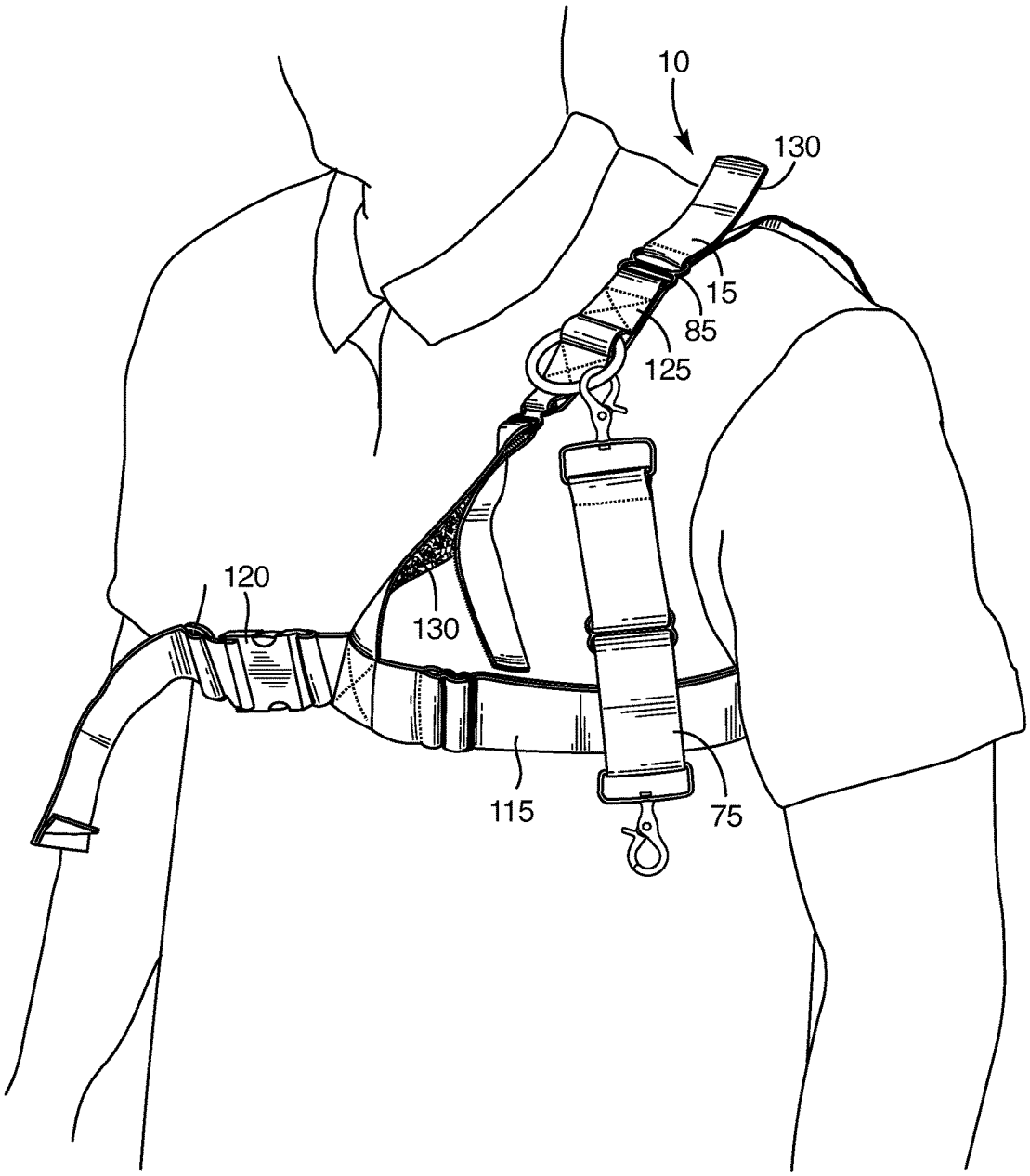
Figure 4C:
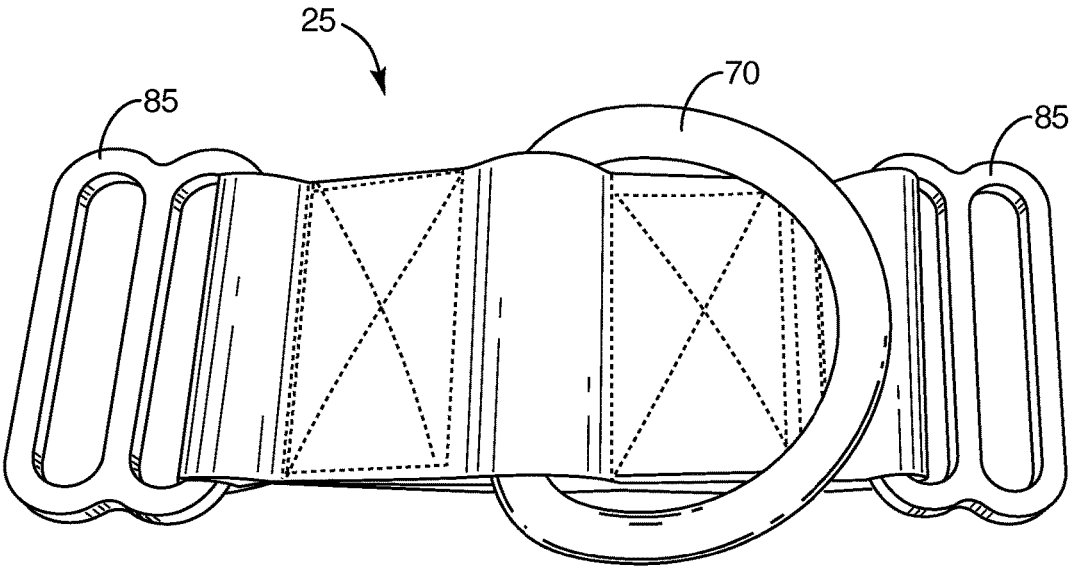
FIG. 4C illustrates a perspective view of a representative embodiment of an ambidextrous weapon attachment.

In another example of a suitable modification of the proposed system 10, in some embodiments (e.g., some embodiments comprising the chest strap 115), the shoulder strap 15 comprises an ambidextrous weapon attachment that is configured to be selectively attached to and detached from the shoulder strap such that the shoulder strap can be worn on either the right or the left shoulder (e.g., as shown in FIGS. 4A and 4B, respectively). In such cases, the ambidextrous weapon attachment can be selectively coupled to and/or be decoupled from the shoulder's strap in any suitable manner, including, without limitation, through the use of one or more quick-release mechanisms, buckles, hook-and-loop fasteners, slides (e.g., a double-bar slides, triple-bar slide, etc.), snaps, zippers, clips, elongated pieces of materials that are configured to receive any of the foregoing, and/or other suitable mechanisms. By way of non-limiting illustration, FIGS. 4A-4C show some embodiments in which the ambidextrous weapon attachment 125 attaches to the shoulder strap 15 via a pair of triple-bar slides 85 and a set of hook-and-loop fasteners 130.

In another example of a how the carrying system 10 can be modified, in some embodiments in which the carrying system comprises a chest strap 115, instead of being configured to extend all the way around a user's chest, the chest strap extends around a portion of the user's chest, and is attached to the upper torso garment (or another item) in such a manner that the upper torso garment spans a remainder of the circumference of the user's chest. In such embodiments (which are not shown herein), the chest strap can attach to the upper torso garment in any suitable manner, including, without limitation, via one or more attachment mechanisms 20 (as discussed above).

In even another example, the described carrying system 10 can be modified to have any suitable number of straps that are configured to attach to any suitable portion of a user's body, any suitable portion of an upper torso garment, and/or any suitable portion of an article of clothing. Indeed, in some embodiments, the system includes shoulder straps for both of a user's shoulders, a waist strap, one or more leg straps, and/or any other suitable strap. In other embodiments, the system only has a single shoulder strap 15 (as shown in FIGS. 1-4B) or is otherwise configured such that the system only goes on one of its user's shoulders (and, in some cases, across the user's chest). Moreover, in some embodiments, the carrying system does not comprise any leg straps, waist straps, and/or other straps.

Figure 4D:
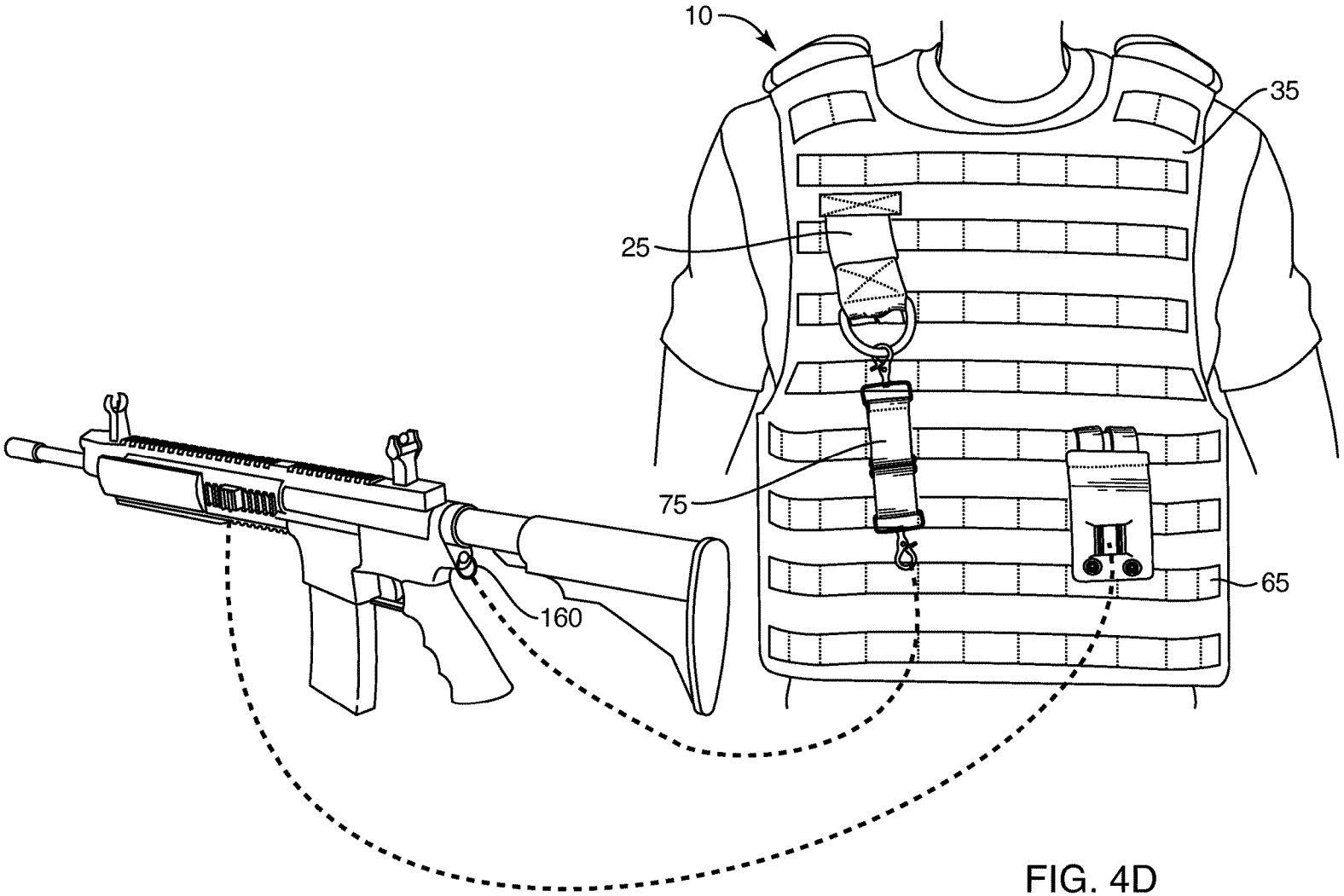
FIG. 4D illustrates an elevational view of a user wearing an upper torso garment having the weapon carrying system attached thereto, in accordance with some embodiments of the invention.

As still another example of a suitable modification of the described carrying system 10, in some embodiments, one or more components of the system are incorporated into an upper torso garment (e.g., vest 35). In such embodiments, any suitable portion of the system can be incorporated into any suitable portion of the garment. Indeed, in one example, the shoulder strap 15 is sewn into and/or onto (or otherwise permanently attached to) the garment. In another example, the chest strap 115 is sewn into and/or onto (or otherwise attached to) the garment. In still another example, (as shown in FIG. 4D) a portion of the weapon attachment 25 is sewn into/onto (or is otherwise attached to) the upper torso garment (e.g., vest 35).

In addition to, or in place of, the shoulder strap 15, the chest strap 115, and/or any of the other aforementioned components, some embodiments of the carrying system 10 comprise a weapon stabilizer. In such embodiments, the weapon stabilizer can perform any suitable function. Indeed, in some embodiments in which a first portion of a weapon (e.g., a sling mount on a rifle) or another suitable object is connected to the described weapon attachment 25 and/or a new or known gun sling, the weapon stabilizer can help selectively and releasably maintain a second portion of the weapon (e.g., a barrel or other portion of the weapon or another object) in a desired position.

While the weapon stabilizer can comprise any suitable component, in some embodiments, it comprises a first and a second connection element that are configured to selectively connect to and disconnect from each other. With regards to these connection elements, some embodiments of the first element are configured to attach to an article of clothing (e.g., an upper torso garment, belt, pair of pants, etc.). In contrast, some embodiments of the second connection element are configured to attach to the weapon.

Figure 5:
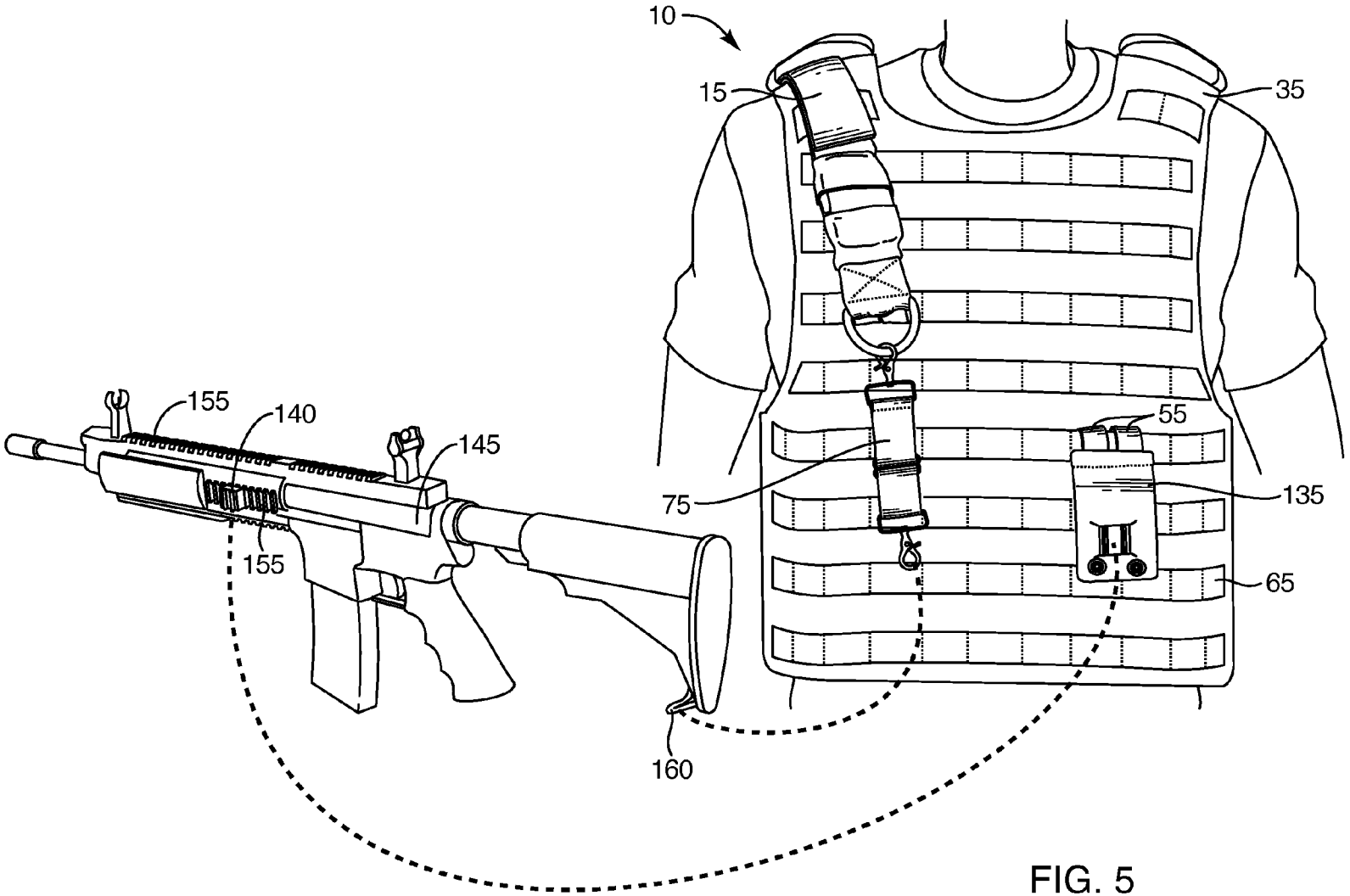
FIG. 5 illustrates an elevational view of a user wearing the weapon carrying system and a weapon stabilizer in accordance with a representative embodiment of the invention.
Figure 6:
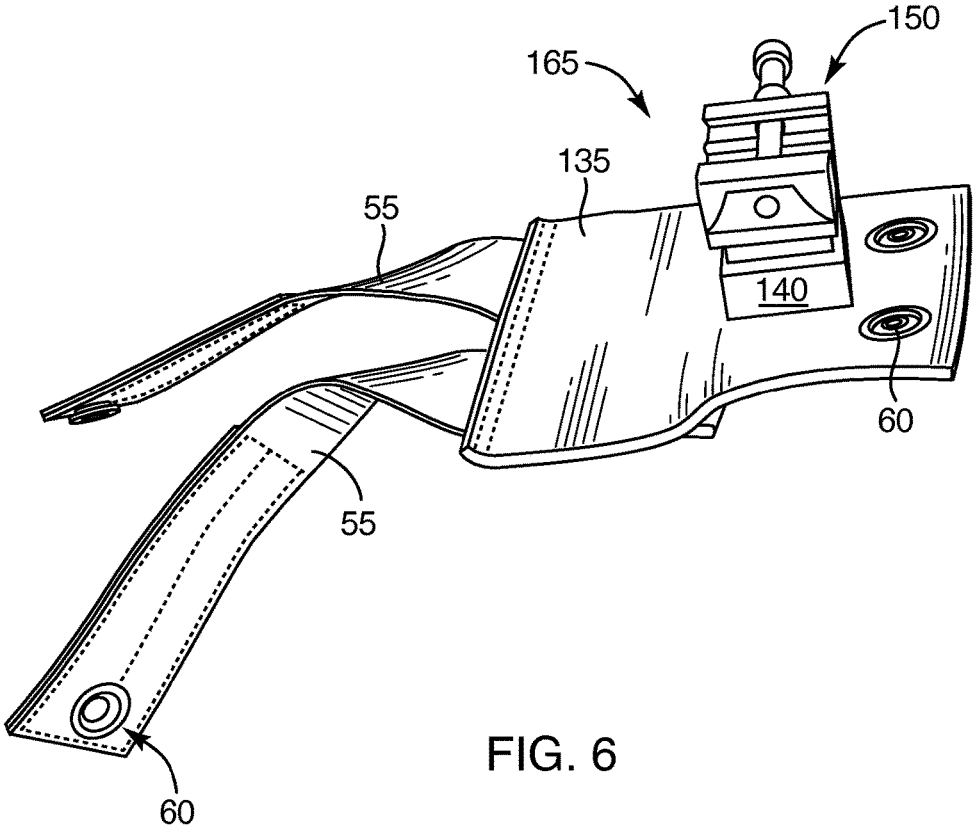
FIG. 6 illustrates a front perspective view of a representative embodiment of the weapon stabilizer.
Figure 7:
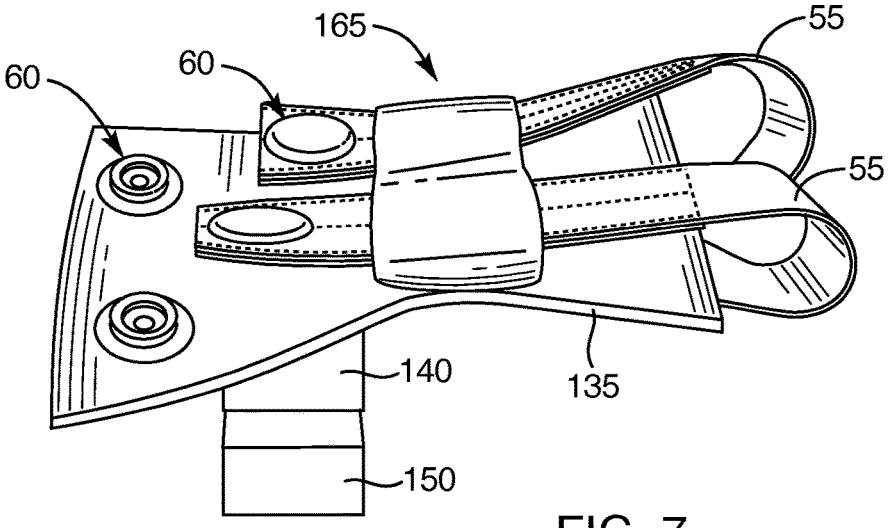
FIG. 7 illustrates a back perspective view of the weapon stabilizer, in accordance with at least some embodiments of the invention.

With respect to the first connection element, the first element can connect to an article of clothing in any suitable manner, including, without limitation, through the use of one or more attachment mechanisms 20 (as discussed above). In accordance with some embodiments, however, FIGS. 5-7 show the first connection element 135 connects to an upper torso garment (e.g., vest 35) or other article of clothing via one or more straps 55 with snaps 60. Additionally, while the first connection element can attach to any suitable portion of an article of clothing (e.g., a belt, pocket, strap, clip, and/or other suitable portion), FIG. 5 shows an embodiment in which the first connection element 135 connects to an article of clothing (e.g., vest 35) by coupling with MOLLE webbing 65.

With respect to the second connection element, the second element can connect to a weapon (or other suitable object) in any suitable manner, including, without limitation, via one or more straps, ties, cables, ropes, accessory attachments (which is used herein to include rail mounts, such as one or more MIL-STD-1913 rails, STANAG 2324 rails, tactical rails, WEAVER™ rails, etc.), and/or in any other suitable manner. In accordance with some embodiments, however, FIGS. 5 and 6 show embodiments in which the second connection element 140 attaches (or is configured to attach) to a weapon (e.g., a firearm 145) via a known or novel accessory attachment 150 (or a rail mount). Additionally, while the second connection element can attach to any suitable portion of a weapon (or other suitable object), FIG. 5 shows an embodiment in which the second connection element 140 attaches to an accessory mount 155 (or rail) on the weapon 145. As such, FIG. 5 shows that, in at least some embodiments, the weapon 145 can be hung from a sling connector 160 that attaches to any of the embodiments of the described weapon attachment 25, while a second portion of the weapon (e.g., the barrel, hand guard, etc.) can be held close to the user and in a desired resting position via the weapon stabilizer 165 (e.g., the first 135 and second 140 connection elements).

Figure 8:
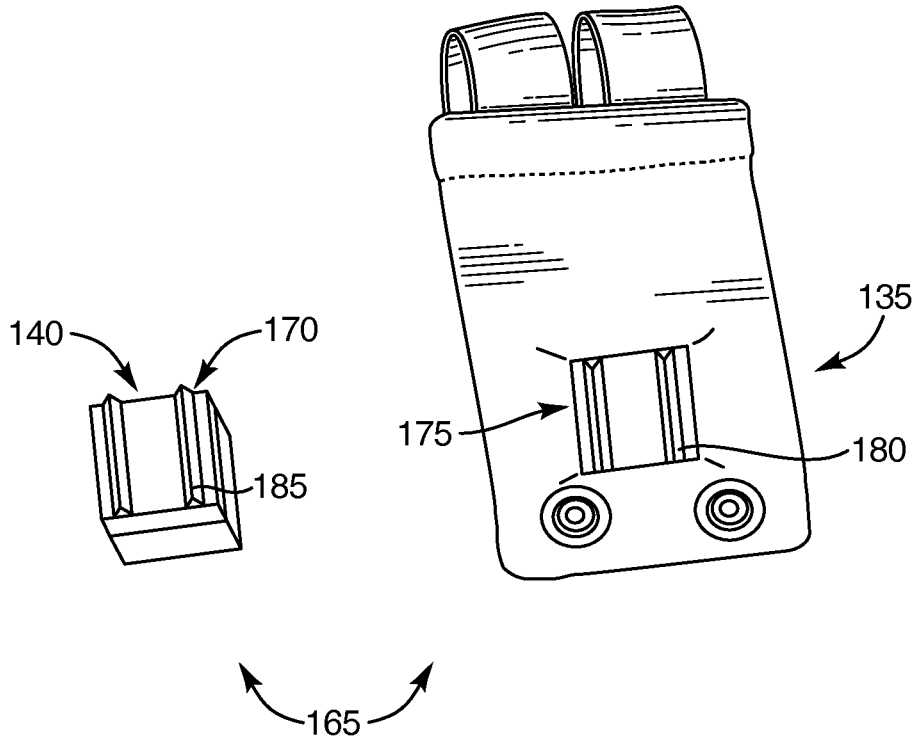
FIGS. 8-10 each illustrate a view of a different representative embodiment of the weapon stabilizer.

The first 135 and the second 140 connection elements can selectively attach to and detach from each other in any suitable manner, including, without limitation, by having each of the elements comprise a complimentary portion of a hook-and-loop fastener (e.g., an industrial strength fastener); by one of the elements comprising a tab and the other comprising a corresponding slot; etc.); by one of the elements comprising a first magnet while the other comprises a second magnet and/or a magnetic material; and/or with any other suitable mechanism that allows the first and second elements to selectively attach to and detach from each other. In one illustration, FIG. 8 shows that some embodiments of the weapon stabilizer 165, at least one of the first 135 and second 140 connection elements comprises a magnet 170, while the other comprises either a magnetic material or another magnet 175.

Where the first 135 and second 140 connection elements each comprise a magnet 170 and/or a magnetic material, the two connection elements can have any other suitable characteristic. For instance, while some embodiments of the two connection elements are configured to abut with each other at relatively flat surfaces, in other embodiments, the connection elements are configured to have mating surfaces. In this regard, the two elements can have any suitable mating surfaces, including, without limitation, one or more corresponding convex and concave surfaces, corresponding ridges and grooves, and/or any other suitable surfaces that allow the first and second elements to selectively attach to and detach from each other. By way of non-limiting illustration, FIG. 8 shows an embodiment in which the first 135 and second 140 connection elements comprise corresponding grooves 180 and ridges 185, respectively, that help guide the direction in which the weapon is moved as the first and second connection elements are separated.

Figure 9:
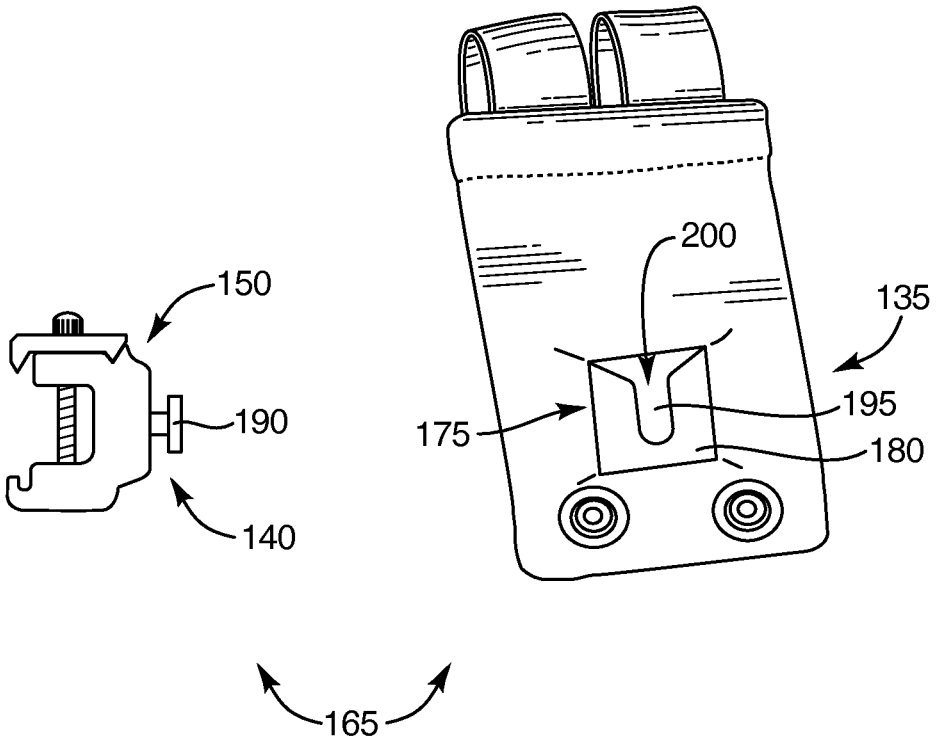
Figure 10:
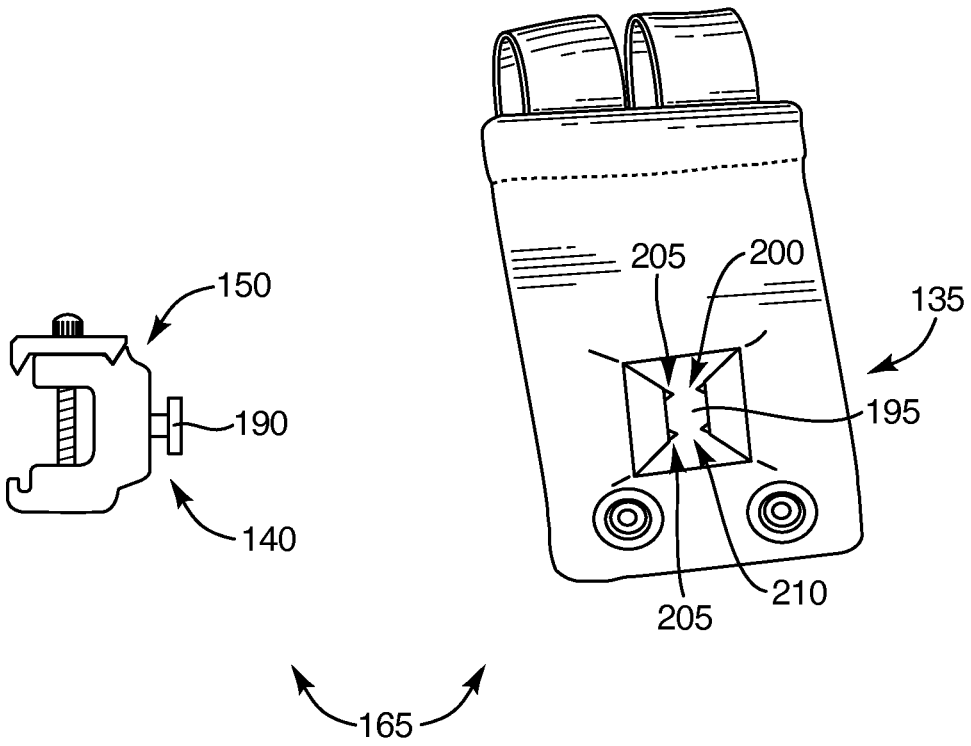

In still other non-limiting illustrations, FIGS. 9 and 10 show that, in some embodiments, the second 140 and first 135 connection elements, respectively, comprise a tab 190 and corresponding slot 195. While such tabs and slots can have any suitable characteristic, FIGS. 9 and 10 respectively show some embodiments in which the tab 190 can only enter the slot 195 from a first entrance 200 and in which the tab 190 can enter the slot 195 (e.g., by passing a detent mechanism 205) at a first 200 or second 210 entrance.

The described carrying system 10 can comprise any suitable materials that allow the system to function as intended. Indeed, in some embodiments, the carrying system comprises one or more pieces of fabric (e.g., polyester, nylon, cotton, para-aramid synthetic fiber, and/or any other suitable fabric), synthetic material, rope, leather, metal, plastic, cording, and/or other suitable material. In accordance, with some embodiments of the invention, however, the described systems comprise straps of webbing (e.g., nylon webbing, polyester webbing, etc.). In such embodiments, the various pieces of webbing can have any suitable characteristic (e.g., length, width, thickness, strength, color, weave, etc.). In some embodiments, however, the webbing is between about 0.1 inches and about 10 inches in width, or any sub-range thereof (e.g., between about 0.5 inches and about 4 inches).

The described carrying system 10 can also be made in any suitable manner. In this regard, some non-limiting examples of methods for making the described system include, weaving, knitting, sewing, cutting, connecting with mechanical fasteners (e.g., clips, clamps, rivets, crimps, pins, etc.), melting pieces together, and/or any other suitable method that allows the described systems to perform their intended functions.

In addition to the aforementioned features, the described carrying system 10 can comprise any other suitable feature. In one example, as some embodiments of the described systems have very little (if any) "sling," the described systems may be less likely to become tangled, or otherwise, interfere with a user's gear than may some conventional gun slings. In another example, as some embodiments of the described systems are configured to hold a weapon (or other object) in a natural position between the user's arm and the user's core (e.g., sternum), some such embodiments can allow a user to rapidly and easily move the weapon into an aiming (or other desired) position. In still another example, some embodiments of the described systems are configured to readily release a weapon (e.g., by removing the lanyard 75 from the weapon attachment 25, by removing the lanyard from the weapon, etc.). In yet another example, in some embodiments (e.g., where the shoulder strap 15 is coupled to an upper torso garment, where the shoulder strap is coupled to the chest strap 115, etc.), the carrying system is configured to substantially maintain its position with respect to a user, thus requiring little to no readjustment of the system during use. In even another example, some embodiments of the describe system (e.g., embodiments comprising the weapon stabilizer 165) are configured to hold a weapon 145 in such a manner that the weapon does not swing around and hit the user.

Thus, as discussed herein, embodiments of the present invention embrace systems and methods for carrying a weapon. In particular, some implementations of the present invention relate to systems and methods for carrying a firearm (such as an assault rifle) in a position that allows a user to rapidly move the weapon into a position in which the user can aim and fire the weapon.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope. In addition, as the terms on, disposed on, attached to, connected to, coupled to, etc. are used herein, one object (e.g., a material, element, structure, member, etc.) can be on, disposed on, attached to, connected to, or coupled to another object—regardless of whether the one object is directly on, attached, connected, or coupled to the other object, or whether there are one or more intervening objects between the one object and the other object. Also, directions (e.g., anterior, posterior, front back, on top of, below, above, top, bottom, side, up, down, under, over, upper, lower, lateral, etc.), if provided, are relative and provided solely by way of example and for ease of illustration and discussion and not by way of limitation. Where reference is made to a list of elements (e.g., elements a, b, c), such reference is intended to include any one of the listed elements by itself, any combination of less than all of the listed elements, and/or a combination of all of the listed elements. Furthermore, as used herein, the terms a, an, and one may each be interchangeable with the terms at least one and one or more.

What is claimed is:

1. A shoulder strap for carrying a weapon, the shoulder strap comprising:

a shoulder strap that is configured to attach at a shoulder portion of an upper torso garment;

an attachment mechanism configured to attach the shoulder strap to the shoulder portion of the upper torso garment, the attachment mechanism comprising:

a first connector that is configured to attach to a back portion of the upper torso garment; and a second connector that is configured to attach to an anterior portion of the upper torso garment;

a shoulder strap separation mechanism that is disposed in the shoulder strap between the first connector and the second connector, and that is configured to selectively release to separate a first and a second portion of the shoulder strap; and a weapon attachment that is attached to the shoulder strap so as to be disposed on an anterior portion of the shoulder strap when the shoulder strap is worn by a user.

2. The shoulder strap of claim 1, wherein the attachment mechanism comprises a first strap that is configured to connect to a connection point on the anterior portion of the upper torso garment.

3. The shoulder strap of claim 2, further comprising the upper torso garment, and wherein the connection point on the anterior portion of the upper torso garment comprises a piece of MOLLE webbing that is coupled to and disposed on the upper torso garment.

4. The shoulder strap of claim 1, wherein the attachment mechanism comprises a first strap that is configured to connect to a connection point on eon the back portion of the upper torso garment.

5. The shoulder strap of claim 1, wherein an overall length of the shoulder strap between the first connector and the separation mechanism is adjustable.

6. The shoulder strap of claim 1, wherein the weapon attachment is attached to the second portion of the shoulder strap.

7. The shoulder strap of claim 1, wherein the weapon attachment is attached to the first portion of the shoulder strap.

8. The shoulder strap of claim 1, wherein the weapon attachment further comprises an attachment point and a lanyard, wherein the lanyard comprises a first connector that is configured to attach to the attachment point and a second connector that is configured to attach to the weapon.

9. The shoulder strap of claim 1, further comprising a sleeve that is configured to cover a portion of the shoulder strap separation mechanism to prevent debris from entering a portion of the separation mechanism.

10. A system for carrying a weapon, the system comprising:

a shoulder strap that is configured to go over a shoulder of a user;

a chest strap that is configured to extend around a torso of the user; and a weapon attachment, wherein the shoulder strap is attached to the chest strap, wherein the weapon attachment is attached to the system at the shoulder strap, wherein the weapon attachment further comprises an attachment point and a lanyard, and wherein the lanyard comprises a first connector that is configured to attach to the attachment point and a second connector that is configured to attach to the weapon.

11. The system of claim 10, wherein the weapon attachment comprises a ring.

12. The system of claim 10, wherein the weapon attachment is selectively removable from the shoulder strap.

13. The system of claim 10, wherein the system is configured to only go across one of the user's two shoulders.

14. A shoulder strap for carrying a weapon, the shoulder strap comprising:

a shoulder strap that is configured to attach at a shoulder portion of an upper torso garment;

an attachment mechanism configured to attach the shoulder strap to the shoulder portion of the upper torso garment; and a weapon attachment that is attached to the shoulder strap so as to be disposed on an anterior portion of the shoulder strap when the shoulder strap is worn by a user, wherein the weapon attachment further comprises an attachment point and a lanyard, wherein the lanyard comprises a first connector that is configured to attach to the attachment point and a second connector that is configured to attach to the weapon.

15. The shoulder strap of claim 14, wherein the attachment mechanism comprises a first strap that is configured to connect to a connection point on the anterior portion of the upper torso garment.

16. The shoulder strap of claim 15, further comprising the upper torso garment, and wherein the connection point on the anterior portion of the upper torso garment comprises a piece of MOLLE webbing that is coupled to and disposed on the upper torso garment.

17. The shoulder strap of claim 14, wherein the attachment mechanism comprises a first strap that is configured to connect to a connection point on the back portion of the upper torso garment.

18. The shoulder strap of claim 14, wherein an overall length of the shoulder strap between the first connector and the separation mechanism is adjustable.

19. The shoulder strap of claim 14, wherein the weapon attachment is attached to the second portion of the shoulder strap.

20. The shoulder strap of claim 14, wherein the attachment mechanism comprises:

a first connector that is configured to attach to a back portion of the upper torso garment; and a second connector that is configured to attach to an anterior portion of the upper torso garment.

* * * * *